US005551937A

United States Patent [19]

Kwo

[11] Patent Number: 5,551,937

[45] Date of Patent: Sep. 3, 1996

[54] BODY INVERSION SUSPENSION EXERCISE DEVICE

[76] Inventor: Chung-Jen Kwo, Room 6, No. 18, San Fu Li, Yang Mei Township, Tao Yuan Hsien, Taiwan

[21] Appl. No.: 368,617

[22] Filed: Jan. 4, 1995

[51] Int. Cl.[6] ..... A63B 26/00

[52] U.S. Cl. ..... 482/144; 482/145

[58] Field of Search ..... 482/144, 143, 482/145, 142

[56] References Cited

U.S. PATENT DOCUMENTS

| | | | |
|---|---|---|---|
| 4,232,662 | 11/1980 | Barber | 482/144 |
| 4,502,682 | 3/1985 | Miller | 482/144 |
| 4,531,731 | 7/1885 | Law | 482/144 |
| 4,546,972 | 10/1985 | Goyer | 482/144 |
| 4,717,148 | 1/1988 | Brewer | 482/144 |
| 4,867,143 | 9/1989 | Morin | 482/144 |

*Primary Examiner*—L. Reichard
*Attorney, Agent, or Firm*—Browdy and Neimark

[57] ABSTRACT

An exercise device comprises a frame, a back rest set and a leg pressing rod. The back rest set is mounted obliquely on the frame and provided with a back rest having respectively on two sides thereof with a hanging member. The back rest is provided on the back thereof with a fastening rod and two hanging lugs fastened respectively to the hanging member for fastening the back rest with the frame. The leg pressing rod comprises a height adjusting rod to which two rest pads, one pedal and one operating rod are fastened pivotally. The operating rod is provided at the lower segment thereof with another two rest pads and at the upper segment thereof with a plurality of projections spaced equidistantly. The operating rod and the height adjusting rod are joined together by a retaining ring to restrain both legs of an exerciser who can do an upside-down exercise by placing his or her feet on the pedal, having his or her legs located by the leg pressing rod, and lying on the back rest.

2 Claims, 6 Drawing Sheets

BODY INVERSION SUSPENSION EXERCISE DEVICE

FIELD OF THE INVENTION

The present invention relates generally to an exercise machine, and more particularly to an exercise device for promoting the blood circulation of an exerciser.

BACKGROUND OF THE INVENTION

There are a variety of exercise devices available in the market today. Most of these exercise devices are intended for use in building muscles of an exerciser and are therefore not suitable for use by a middle-aged person or a woman, who is generally more interested in keeping physically fit.

SUMMARY OF THE INVENTION

It is therefore the primary objective of the present invention to provide an exercise device which is simple in construction and can be used easily by a middle-aged person or woman.

It is another objective of the present invention to provide an exercise device, which can be so adjusted to enable a person of any body size to use it for physical fitness.

The foregoing objectives Of the present invention are accomplished by an exercise device comprising a foldable A-shaped frame, a back rest set, and a leg pressing rod. The back rest set is mounted obliquely on the foldable frame and provided with a back rest having respectively on both sides thereof with a hanging member. The back rest is provided on the back thereof with a fastening rod and two hanging lugs fastened respectively to the hanging member for fastening the back rest with the foldable frame. The leg pressing rod comprises a height adjusting rod to which two rest pads, one pedal and one operating rod are fastened pivotally. The operating rod is provided at the lower segment thereof with another two rest pads and at the upper segment thereof with a plurality of equidistantly spaced projections. The operating rod and the adjusting rod are joined together by a retaining ring. An exerciser can do an upside-down exercise by placing his or her feet on the pedal, having his or her legs located by the leg pressing rod, and lying on the back rest.

The foregoing objectives, features and functions of the present invention will be more readily understood upon a thoughtful deliberation of the following detailed description of the embodiment of the present invention in conjunction with the accompanying drawings.

DETAILED DESCRIPTION OF THE INVENTION

Figure 1:
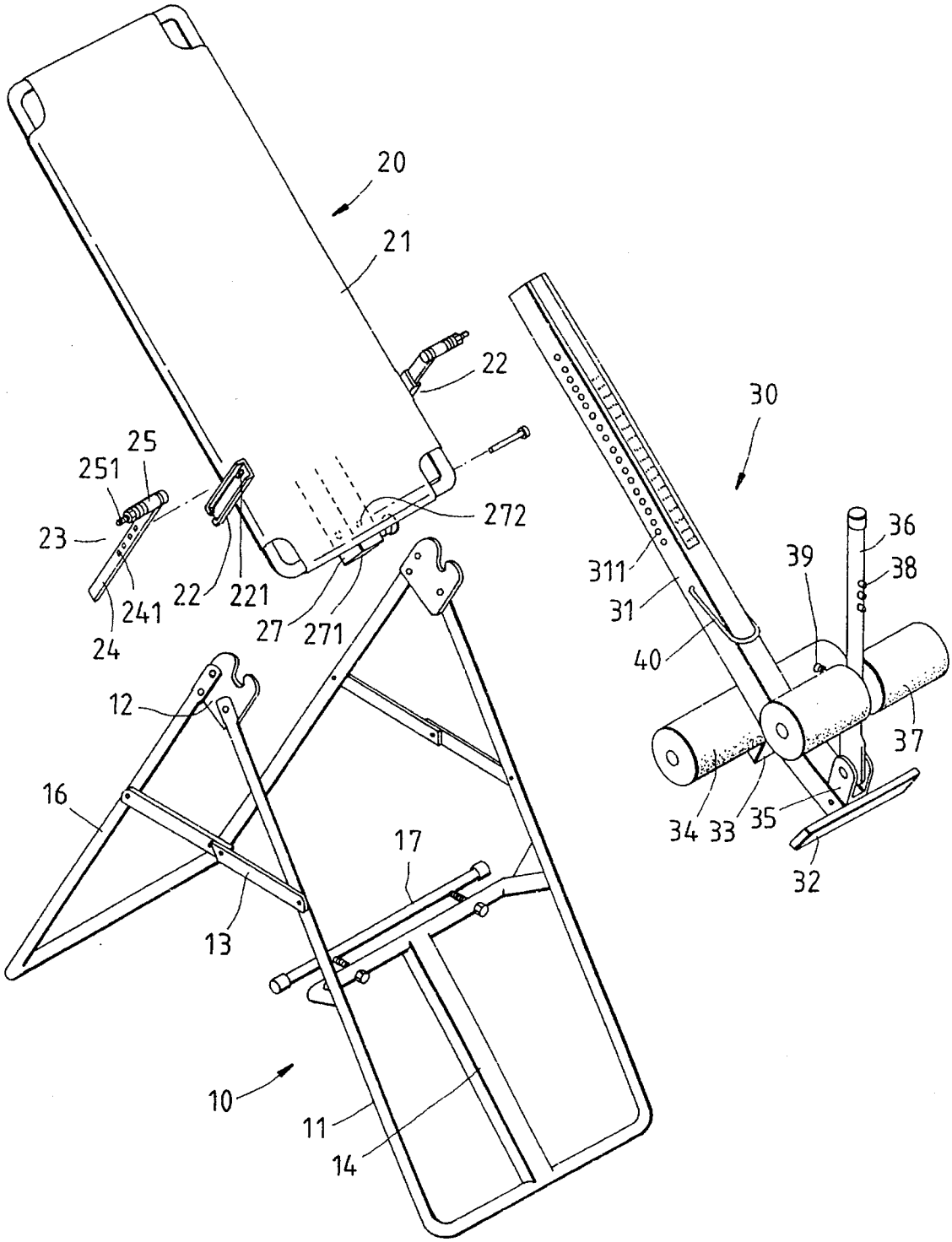
FIG. 1 shows an exploded view of the exercise device of the present invention.
Figure 2:
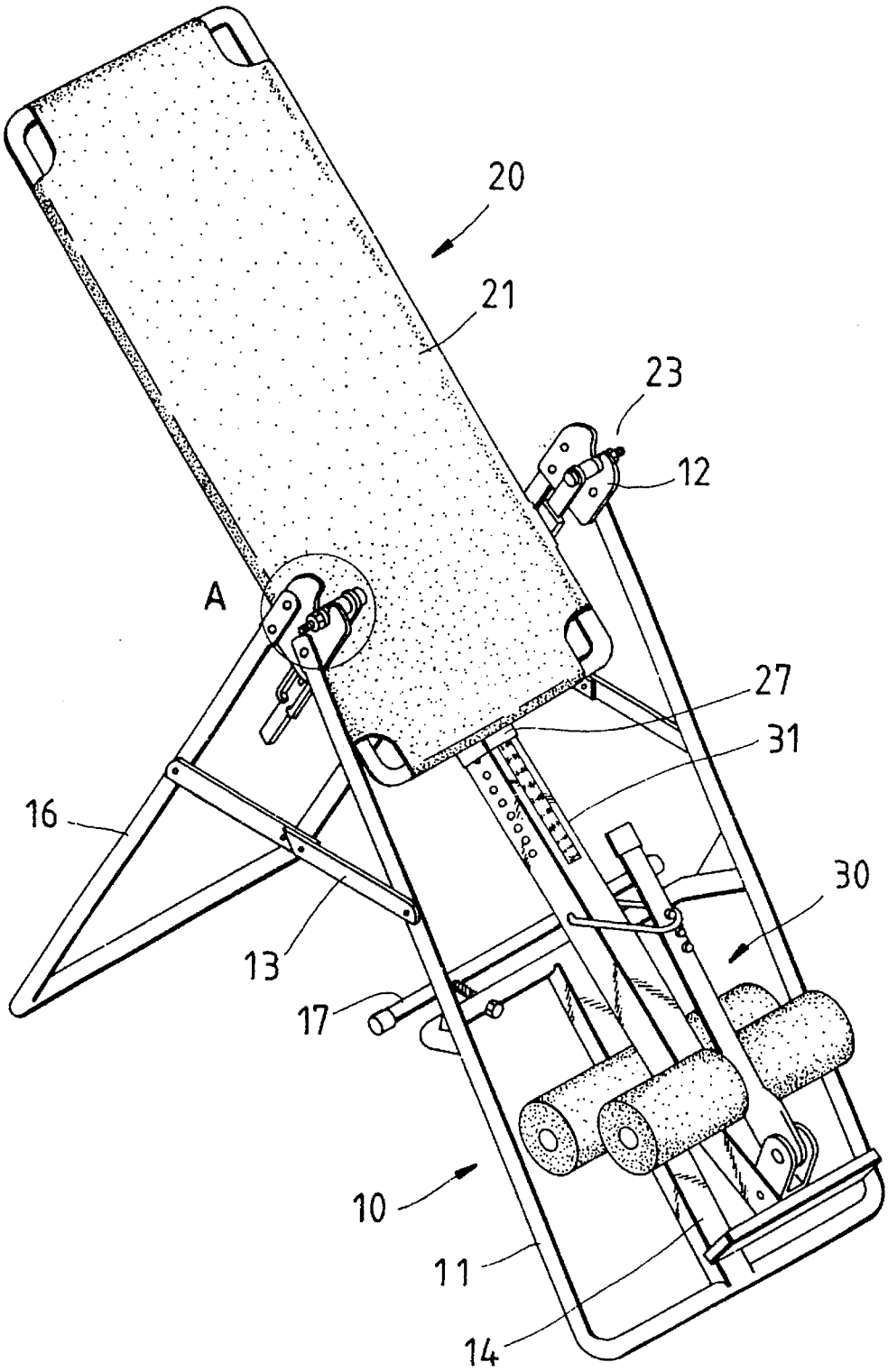
FIG. 2 shows a perspective view of the present invention in combination.
Figure 3:
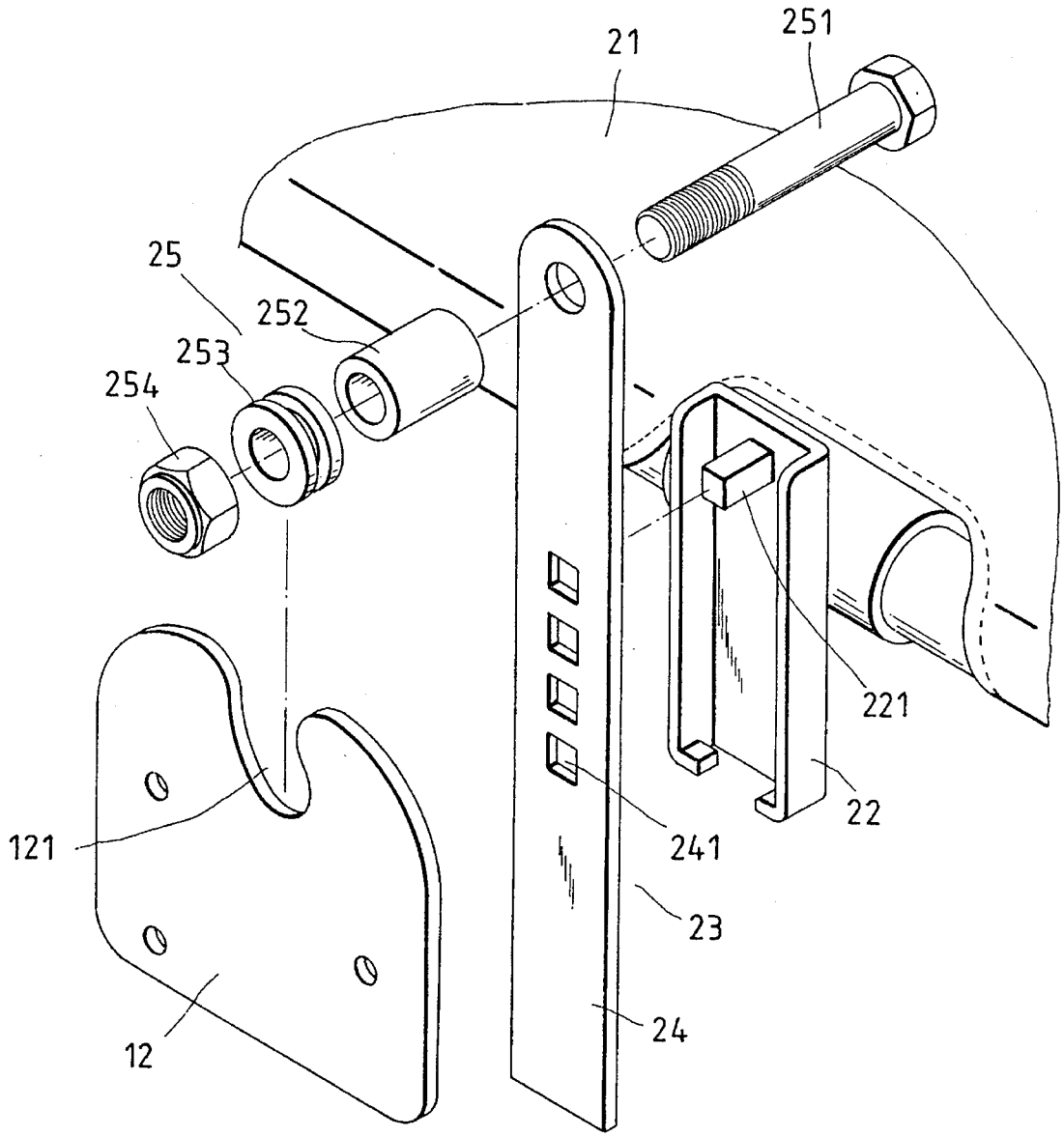
FIG. 3 shows an exploded view of a portion indicated by a circle A as shown in FIG. 2.

As shown in FIGS. 1–3, the exercise device of the present invention comprises the component parts which are described explicitly hereinafter.

A frame 10 comprises two U-shaped frames 11 and 16, which are provided respectively and correspondingly at the top thereof with two hanging plates 12 by which the two U-shaped frames 11 and 16 are pivoted. The two U-shaped frames 11 and 16 are supported at midsegments thereof with two support arms 13. The U-shaped frames 11 and 16 can be swiveled on the two hanging plates 12 and folded or unfolded by the two support arms 13. An arresting frame 14 of a T-shaped construction has three free ends which are fastened respectively with the U-shaped frame 11. Fastened to the back side of the arresting frame 14 is a cushioning rod 17.

A back rest set 20 is mounted on the frame 10 and composed of a back rest 21 of a canvas material. The back rest set 20 has two longitudinal rods which are provided respectively and correspondingly With a hanging member 22 of a rectangular construction. The hanging member 22 is provided with an insertion block 221 and a hanging lug set 23 having a hanging piece 24 which is provided with a plurality of through holes 241. As best shown in FIG. 3, each suspension shaft 25 is fastened to the top of the hanging piece 24 by a threaded rod 251 thereof and is joined with a shaft sleeve 252, a locating sleeve 253 and a nut 254. The locating sleeve 253 is provided with a circular groove with which a recessed area 121 of the hanging plate 12 of the frame 10 is engaged. The two hanging pieces 24 of the two hanging lugs 23 are retained on the insertion blocks 221 of the hanging members 22 of the back rest 21, the circular grooves of the locating sleeves 253 of the two suspension shafts 25 can be retained in the recessed areas 121 of the hanging plates 12 of the frame 10. As a result, the back rest 21 can be swiveled obliquely in relation to the frame 10. A fastening rod 27 is fastened to the back rest 21 and provided longitudinally with a through hole 271 and at least one insertion hole 272 in which an insertion pin is disposed.

A leg pressing rod 30 comprises a height adjusting rod 31 having a height scale marked thereon and further having a plurality of through holes 311 corresponding respectively in location to the height scale marks. The through holes 311 can be arranged coaxially with the insertion holes 272. Fastened to the bottom of the height adjusting rod 31 is a pedal 32. The height adjusting rod 31 is provided with an arresting column 33 adjacent to the pedal 32. The arresting column 33 is provided with two rest pads 34. An operating rod 36 is fastened pivotally to the bottom of the height adjusting rod 31 by pivoting lugs 35 and is provided with a set of rest pads 37 adjacent to the pivoting lugs 35. The operating rod 36 is provided with a plurality of projections 38 which are spaced equidistantly and are distal from the pivoting lugs 35. A retaining ring 40 is joined with the height adjusting rod 31 such that the retaining ring 40 can be caught between the two projections 38 for adjusting the distance between the operating rod 36 and the height adjusting rod 31. Between the rest pad 37 of the operating rod 36 a counter releasing elastic member is centrally mounted for providing a counter releasing elastic force against adjusting rod 31.

Figure 4:
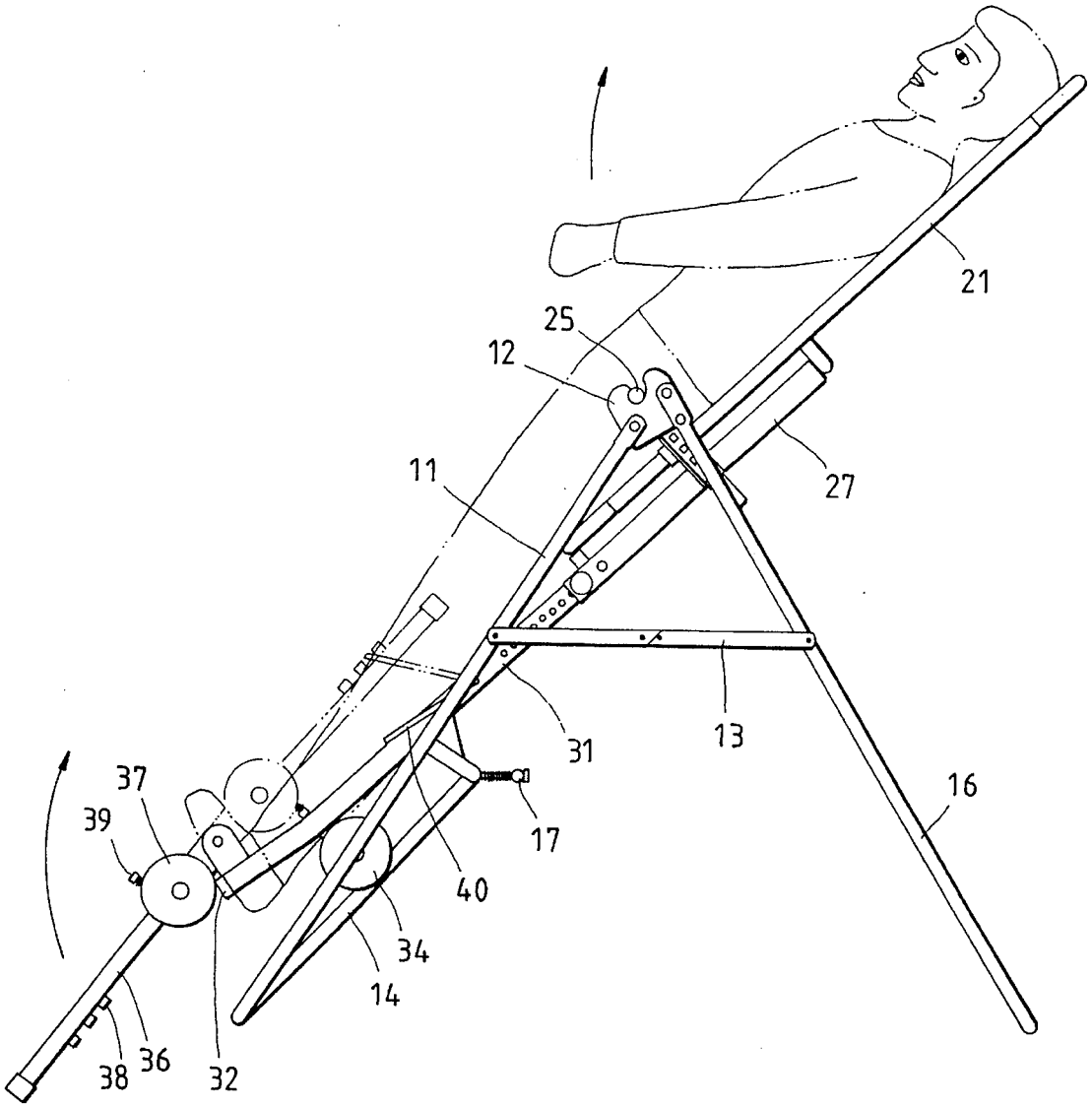
FIGS. 4 and 5 show schematic views of the present invention in action.
Figure 5:
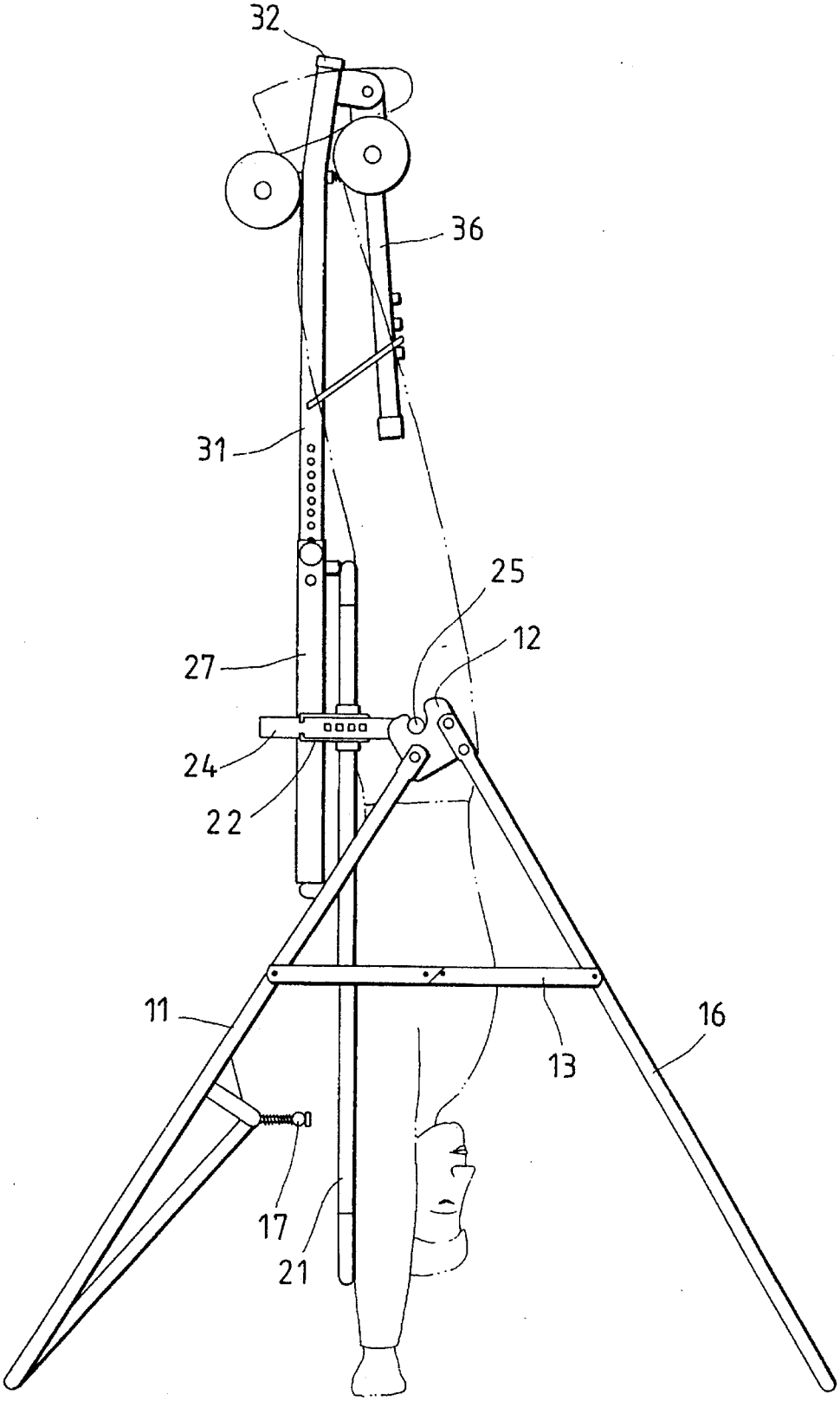

In operation, as best shown in FIGS. 4 and 5 an exerciser stands on the pedal 32 of the leg pressing rod 30 such that the operating rod 36 of the leg pressing rod 30 is allowed to press downwards between the legs of the exerciser. The exerciser lies with relaxation on the back rest 21 and stretches his or her hands backwards and slowly as shown by the arrow in FIG. 4 so as to cause the back rest set 20 to tilt slowly and backwards for an angle of 180 degrees. The swiveling of the back rest set 20 can be checked by the cushioning rod set 17. The exerciser can retrieve his or her position by extending his or her hands forward to cause the weight of his or her lower segment of body to exceed ! the weight of his or her upper segment of body, thereby causing the back rest set 20 to swing back to its original position.

Figure 6:
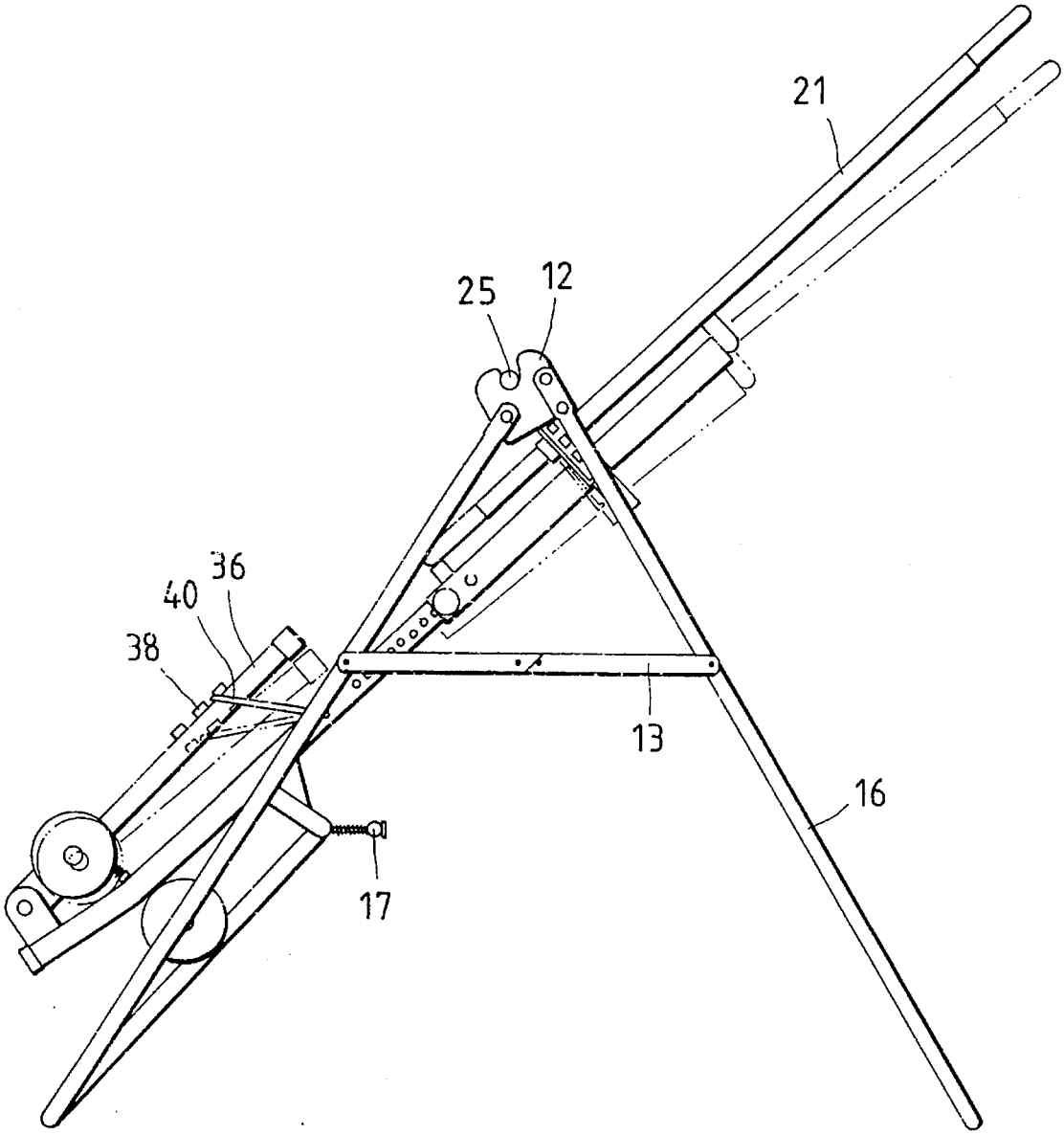
FIG. 6 is a schematic view showing that the back rest is raised and lowered in opposite to the frame and that the back rest and the leg pressing rod are oppositely retained.

As illustrated in FIG. 6, the exercise device of the present invention is suitable for use by persons of various body dimensions in view of the fact that the hanging piece 24 of the back rest set is provided with a plurality of lower through holes 241 engageable with the insertion blocks 221 of the hanging member 22 for causing the back rest 21 to descend appropriately at such time when the exercise device of the present invention is used by a fat person having heavy hips. In other words, the hip center line of the exerciser and the axes of the two suspension shafts 25 are kept coaxially. On the other hand, if the device of the present invention is used by a thin person, the upper through holes 241 of the hanging piece 24 are used so as to shorten the distance between the back rest and the suspension shaft set, thereby causing the hip center line and the axes of the two suspension shafts to remain coaxial. Moreover, the exercise device of the present invention is provided with the height adjusting rod 31 to facilitate the use of the device by persons of various heights. The exercise device of the present invention is further provided with the retaining ring 40 which can be caught securely between two projections 38 of the operating rod 36 so as to restrain adjustably the ankles of various sizes.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An exercise device comprising:

a frame having two U-shaped frames which are provided respectively and correspondingly at a top thereof with two hanging plates each having in a top thereof a recessed area, said frame further having two support arms which are fastened pivotally and respectively with said two U-shaped frames;

a back rest set mounted obliquely on said frame and, composed of a back rest, two hanging lugs, two suspension shafts, and a fastening rod, said back rest having respectively and corresponding on two side thereof a hanging member of a rectangular constructions and having an insertion block, said two hanging lugs being disposed respectively on said hanging member for mounting said back rest on said frame, said two hanging lugs having respectively a hanging piece which is provided with a plurality of through holes engageable with said insertion block of said hanging member, said two suspension shafts being disposed respectively on said hanging piece and provided respectively with a locating sleeve which is provided centrally with a circular groove respectively engageable with each said recessed area of said hanging plates, said fastening rod having longitudinally a through hole and being fastened to said back rest, said fastening rod further having at one end thereof at least one insertion hole dimensioned to receive therein an insertion pin; and a leg pressing rod comprising a height adjusting rod, an operating rod, and a retaining ring, said height adjusting rod having a head which is engageable with said through hole of said fastening rod, said height adjusting rod further having a height scale marked thereon and a plurality of through holes which are so adjustable as to remain coaxial with said insertion hole of said fastening rod and are engageable with said insertion pin, said height adjusting rod further having a rest pad set located at a midsegment thereof and a pedal located at a bottom thereof, said operating rod being fastened pivotally to said height adjusting rod such that said operating rod can be caused to swivel in relation to said height adjusting rod, said operating rod provided at a lower segment thereof with another rest pad set and at an upper segment thereof with a plurality of projections spaced equidistantly, said retaining ring being joined with said height adjusting rod such that said retaining ring can be so moved as to be caught securely between two of said projections of said operating rod;

wherein said pedal of said leg pressing rod permits use by an exerciser to stand thereon in such a manner that both legs of the exerciser are restrained by said operating rod and said height adjusting rod which are connected by said retaining ring; and wherein said back rest can be caused to tilt rearwards when the exerciser lies on said back rest and stretches his or her hands over his or her head;

wherein said another rest pad set of said operating rod is providing centrally with a counter releasing elastic member to bias said height adjusting rod away from said another rest pad set.

2. An exercise device comprising:

a frame having two U-shaped frames which are provided respectively and correspondingly at a top thereof with two hanging plates each having a top thereof a recessed area, said frame further having two support arms which are fastened pivotally and respectively with said two U-shaped frames;

a back rest set mounted obliquely on said frame and, composed of a back rest, two hanging lugs, two suspension shafts, and a fastening rod, said back rest having respectively and correspondingly on two side thereof a hanging member of a rectangular constructions and having an insertion block, said two hanging lugs being disposed respectively on said hanging member for mounting said back rest on said frame, said two hanging lugs having respectively a hanging piece which is provided with a plurality of through holes engageable with said insertion block of said hanging member, said two suspension shafts being disposed respectively on said hanging piece and provided respectively with a locating sleeve which is provided centrally with a circular groove respectively engageable with each said recessed area of said hanging plates, said fastening rod having longitudinally a through hole and being fastened to said back rest, said fastening rod further having at one end thereof at least one insertion hole dimensioned to receive therein an insertion pin; and a leg pressing rod comprising a height adjusting rod, an operating rod, and a retaining ring, said height adjusting rod having a head end which is engageable with said through hole of said fastening rod, said height adjusting rod further having a height scale marked thereon and a plurality of through holes which are so adjustable as to remain coaxial with said insertion hole of said fastening rod and are engageable with said insertion pin, said height adjusting rod further having a rest pad set located at a midsegment thereof and a pedal located at a bottom thereof, said operating rod being fastened pivotally to said height adjusting rod such that said operating rod can be caused to swivel in relation to said height adjusting rod, said operating rod provided at a lower segment thereof with another rest pad set and at an upper segment thereof with a plurality of projections spaced equidistantly, said retaining ring being joined with said height adjusting rod such that said retaining ring can be so moved as to be caught securely between two of said projections of said operating rod;

wherein said pedal of said leg pressing rod permits use by an exerciser to stand thereon in such a manner that both legs of the exerciser are restrained by said operating rod and said height adjusting rod which are connected by said retaining ring; and wherein said back rest can be caused to tilt rearwards when the exerciser lies on said back rest and stretches his or her hands over his or her head;

wherein said frame further comprises an arresting frame having a cushioning rod which is fastened to a back of said arresting frame and is composed of two threaded rods, two springs and one cross rod.

* * * * *